United States Patent [19]

Nicoud

[11] 4,065,326

[45] Dec. 27, 1977

[54] ELECTRICAL CONDUCTORS OF ALUMINUM-BASED ALLOYS AND PROCESS FOR THE MANUFACTURE THEREOF

[75] Inventor: Jean-Claude Nicoud, Saint-Egreve, France

[73] Assignee: Societe de Vente de l'Aluminium Pechiney, Paris, France

[21] Appl. No.: 691,010

[22] Filed: May 28, 1976

[30] Foreign Application Priority Data

May 28, 1975 France ..... 75.17202

[51] Int. Cl.[2] ..... C22F 1/04

[52] U.S. Cl. ..... 148/2; 148/12.7 A

[58] Field of Search ..... 148/2, 11.5 A, 12.7 A, 148/159, 32.5

[56] References Cited

U.S. PATENT DOCUMENTS

| | | | |
|---|---|---|---|
| 1,695,044 | 12/1968 | Hallmann | 148/12.7 A |
| 3,266,945 | 8/1966 | Helling et al. | 148/11.5 A |
| 3,418,177 | 12/1968 | Pryor | 148/12.7 A |
| 3,464,866 | 9/1969 | Pryor | 148/12.7 A |
| 3,613,767 | 10/1971 | Cofer et al. | 164/76 |
| 3,647,565 | 3/1972 | Schroerner | 148/2 |
| 3,706,606 | 12/1972 | DiRusso et al. | 148/12.7 A |
| 3,770,515 | 11/1973 | Besel | 148/11.5 A |
| 3,843,418 | 10/1974 | Oida et al. | 148/12.7 A |

FOREIGN PATENT DOCUMENTS

| | | | |
|---|---|---|---|
| 1,499,266 | 9/1967 | France | 148/11.5 A |
| 45-12374 | 5/1970 | Japan | 148/11.5 A |

*Primary Examiner*—C. Lovell

*Attorney, Agent, or Firm*—Dennison, Dennison, Meserole, and Pollack

[57] ABSTRACT

The invention relates to the field of electrical conductors of aluminum-based alloys. The invention comprises subjecting a wire rod of Al-Mg-Si alloy to continuous quenching, tepid drawing and continuous artificial aging. The invention makes it possible to produce wires and cables for overhead lines with mechanical and electrical characteristics substantially exceeding present standards.

4 Claims, 3 Drawing Figures

Figure 1:
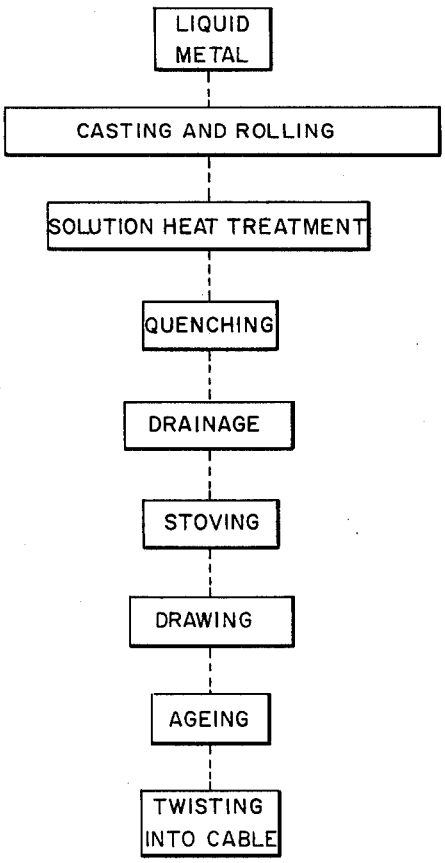

ELECTRICAL CONDUCTORS OF ALUMINUM-BASED ALLOYS AND PROCESS FOR THE MANUFACTURE THEREOF

This invention relates to the manufacture of conductor wires of Al-Mg-Si alloy intended for the production of bare overhead power cables. More precisely, the invention relates to a new method of producing wires which satisfy current requirements, this process affording a certain advantage over the prior art both from the economic point of view and also from the technical point of view.

The process according to the invention comprises the following steps: 1) a continuous quenching treatment carried out immediately after formation of the wire rod; 2) so-called tepid drawing; and 3) an artificial aging treatment carried out separately or continuously after the tepid drawing stage.

Several manufacturing processes have been or may be used for the production of wires of Al-Mg-Si alloy intended for the manufacture of overhead power cables. Among these processes, the following may be mentioned by way of example:

1. Rolling square billets or extruding blooms, welding rings, drawing to approximately three times the final diameter, solution heat treatment plus quenching, drawing to the final diameter and artificial aging.

2. Semicontinuous press extrusion of blooms with water quenching at the output end of the press, drawing to the final diameter, artificial aging.

3. Continuous casting and rolling of wire rod in machines of the Properzi or Spidem type, solution heat treatment in a furnace of spools of wire (approximately 1 ton), followed by quenching, stoving, drawing to the final diameter and artificial aging.

The last of these processes has been the most commonly used for about twenty years because it has the best productivity level both at the formation stage of the wire rod and at the processing stage. It is used for Al-Mg-Si alloys of which the chemical composition may vary from 0.15 to 0.35% for iron, from 0.30 to 0.80% for Mg, from 0.30 to 0.70% for Si, $< 0.20\%$ for Cu, the other elements being those generally present in electricalgrade aluminum alloys.

Unfortunately, a process such as this has a certain number of major disadvantages which may be listed as follows:

1. From the economic point of view — limitation to approximately one ton of the weight of the spools in relation to the dimensions of the solution heat treatment furnaces; the need to have a loosely wound core for the water quenching of the spools, hence an increase in the size of the spools; low productivity of the heat treatment installations for solution heat treatment, quenching and stoving (by comparison with production); extensive handling of the spools of wire during these heat treatments; automation made difficult by the low productivity level and by the fact that the spools are hot, higher than 200° C, as they emerge from the output end of the rolling section.

2. From the metallurgical point of view a. at the wire rod stage; substantial heterogeneity of the mechanical characteristics, in particular inside spools which have undergone the cycle of solution heat treatment, quenching and stoving, on account of the differences in quenching rate between the outside and the inside of the spools, for example

| Position of Sample | R kg/mm² | $A_{200}$ % | $\rho$ $\mu\Omega$ . cm |
|---|---|---|---|
| Outside | 22 | 20 | 3.50 |
| Inside | 19 | 20 | 3.45 |

and risk of abnormal oxidation of the wire rod inside the spools through the retention of water inside the spools which can affect the drawability of the wire;

b. at the drawn wire stage: preservation to the final stage of the heterogeneity of characteristics existing in the spool of wire. This heterogeneity of characteristics makes it difficult to select the final heat treatment conditions (temperature and residence time) for obtaining mechanical and electrical characteristics which comply fully with the reference standards in force (for example NF C 34 125 for a diameter of $\leqq$ 3.6 mm: $R > 33$ kg/mm² – $\rho < 3.28\ \mu\Omega$ ·cm), the average values, so far as cables are concerned, having to be in addition: $R \geqq 34.5$ Kg/mm² and $\rho \leqq 3.25\ \mu\Omega$ ·cm.

The process according to the invention enables all the above-mentioned economic disadvantages to be obviated.

From the metallurgical point of view, it is possible by virtue of the process according to the invention to eliminate all the heterogeneities of characteristics both at the wire rod level and at the level of the drawn and treated wire, these heterogeneities emanating from the quenching of spools, In addition, the wires produced by this process show mechanical and electrical characteristics which largely comply with the reference standards, coupled with service properties equivalent to those of wires produced by conventional processes.

In addition, it is known that wires of aluminum alloy can be continuously produced by the process which is the subject of U.S. application Ser. No. 824,220, filed May 13, 1969, now U.S. Pat. No. 3,613,767, Oct. 19, 1971. This process essentially comprises rapidly cooling the rod issuing from the rolling section to a temperature below about 240° C.

By applying this conventional process to an alloy with the following composition: Fe: 0.37%, Mg: 0.69%, Si: 0.51%, it is possible to obtain, after drawing the wire rod from 9.52 mm to a diameter of 1.7 mm and after a final artificial aging/recovery treatment (3 hours at 149° C), interesting combinations of mechanical and electrical characteristics:

R : 33.7 kg/mm²
A : 8%
$\rho$ : 3.28 $\mu\Omega$ . cm
$C^{te}$ : 52.5% LACS

However, these characteristics obtained under the most favorable conditions and for a high elongation (from $\phi$ 9.5 to $\phi$ 1.7, i.e. $(S - s/s) \times 100$ = approximately 3000%) are not so good that it could be hoped to use this process as a basis for the manufacture of overhead cables in accordance with French Standard NF C 34 125 in particular, but also in accordance with the main corresponding foreign standards.

In addition, it is known (cf. French Patent No. 1,499,266) that the drawing of Al-Mg-Si alloy wire, after quenching and aging, at a temperature below the rapid precipitation temperature which is of the order of 200° C and above the normal drawing temperatures of from 20° to 70° C results, in the case of drawing at 110°, in an increase in the ultimate tensile strength of 1 to 1.5 kg/mm² for equal resistivity after the final artificial aging/recovery treatment carried out at a temperature of 165° C.

The present invention relates to an improved process for economically producing wires of Al-Mg-Si alloy having outstanding mechanical and electrical characteristics and intended for the manufacture of overhead power cables or more generally, for the production of bare or insulated cables of the kind used in electrical engineering. The product of the invention may also be used with advantage for applications other than electrical applications, in particular, for mechanical applications.

In a first stage, the process comprises continuously producing a wire rod of Al-Mg-Si alloy by casting and rolling in a machine of the Properzi type, followed immediately at the output end of the last stand by rapid cooling to a temperature below the temperatures at which a significant precipitation hardening of $Mg_2Si$ takes place from a supersaturated solid solution, i.e. to a temperature below 200° C and preferably below 150° C.

It is known that the liquid metal entering the casting wheel at a temperature of approximately 700° C, the solidified metal leaving the casting wheel in a form of a substantially trapezoidal bar and entering the rolling section shortly afterwards (approximately 1 minute between the casting wheel and the rolling section), is at a temperature which can vary from 400° to 500° C, this latter temperature being substantially the temperature below which the solid solution obtained after solidification, in the case of sufficiently slow cooling, rejects magnesium and silicon. Since rolling of the bar ($S \sim 2240$ mm$^2$) into the wire rod ($\phi$ 9.5 mm or $\phi$ 7.5 mm) takes place in a relatively short time (of the order of 1 minute), and since the temperature of the wire rod at the output end of the rolling section is in the range from 250° to 350° C, depending upon the conditions under which casting and rolling are carried out, it can be seen that several functions are performed simultaneously in the rolling section, namely: shaping, cold-working and dynamic recovery resulting from the high temperature deformation and quenching of the bar from the temperature at which it enters the rolling section. A rapid cooling process of the type described, for example, in French Patent 2,261,816 and corresponding U.S. Pat. No. 3,945,623 in the name of Aluminium Pechiney prevents any significant precipitation in the wire rod which would be reflected in a loss of reactivity during hardening by drawing and in the absence of structural hardening by artificial aging.

In view of the solution state of the magnesium and silicon, which is less perfect than in the case of conventional processes which comprise heating the metal from ambient temperature to the solution heat treatment level before quenching of the wire rod, the process according to the invention, in a second stage, comprises carrying out so-called tepid deformation in a temperature range corresponding to the low precipitation rates. A temperature range such as this is from 110° to 180° C and preferably from 130° to 160° C (the temperature having to be selected in dependence upon the degree of cold-working, upon the rate and hence upon the time taken by the tepid drawing process) in the case of Al-Mg-Si alloys with the following composition: Fe = 0.14 - 0.35%, Si = 0.30 - 0.70%, Mg : 0.30 - 0.80%, Cu < 0.20%.

It is surprisingly possible by carrying out drawing at these temperatures and with an elongation level in excess of 350% $(S - s/s) \times 100 \geqq 350\%$, (S being the diameter of the wire on entry, $s$ being the diameter of the wire on exit) to improve the final characteristics (couple $R - \rho$) obtained after final artificial aging by virtue of a finer distribution of the hardening $Mg_2Si$ constituents which precipitate during the tepid drawing operation and by virtue of the elimination during the tepid drawing operation of Guinier Preston zones formed by aging after quenching and contributing significantly towards the electrical resistivity, but only negligibly to precipitation hardening.

The tepid drawing operation is carried out with wire rod in different ways, i.e. with a spool of cold wire, in which case the wire is cold on entering the drawing arrangement or, preferably, is gradually preheated to the tepid drawing temperature, or with a spool of wire preheated in a furnace to a temperature below the tepid drawing temperature and not exceeding 140° C, at which temperature a significant hardening effect is obtained, being reflected in reduced drawability.

One method of carrying out the tepid drawing operation comprises, for example, drawing the wire in a multiple-pass machine with in-line capstans and functioning by immersion, the bath of lubricant being thermostatically controlled to the tepid drawing temperature and the drawing die being sprayed with this same thermostatically controlled lubricant.

After tepid drawing, the wire is heat treated either in a static batch furnace at nominal temperatures in the range from 130° to 170° C for periods ranging from 30 minutes to 12 hours, or preferably continuously on leaving the tepid drawing arrangement at nominal temperatures in the range from 180° to 240° C over periods ranging from 1 to 30 seconds.

One way of carrying out a heat treatment such as this is, for example, to pass the wire continuously through an oil bath furnace which also makes it possible to obtain a wire which is perfectly lubricated and, hence, eminently suitable for the subsequent cable-forming operation.

This heat treatment has a recovering effect and also promotes precipitation hardening which is reflected in particular in an increase in electrical conductivity and a restoration of plasticity (elongation at break) and flexure whilst the mechanical strength of the wires (ultimate tensile strength) remains at a high level.

The invention will be better understood from the accompanying drawings and following examples.

Figure 2:
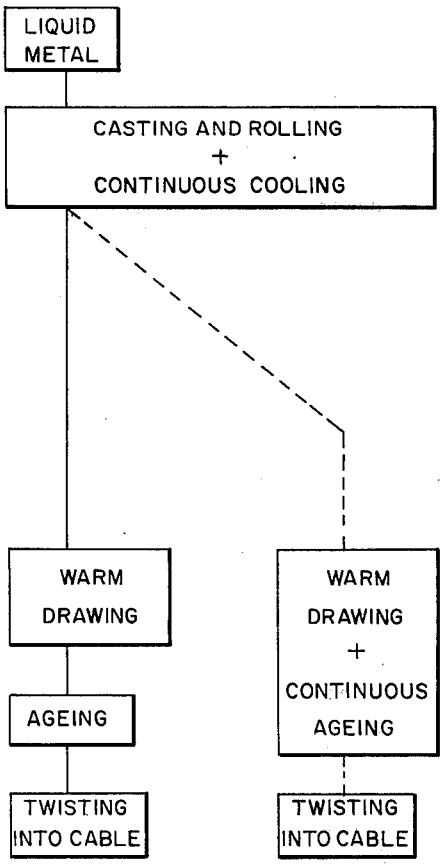
PRIOR ART Fig. 2

FIG. 1 and FIG. 2 diagrammatically illustrate the various processing stages from the liquid metal to the finished electrical cable in accordance with the prior art (conventional third process) and respectively in accordance with the invention. In the latter case FIG. 2, there are two variants, namely conventional artificial aging (in a static furnace) and continuous artificial aging.

Figure 3:
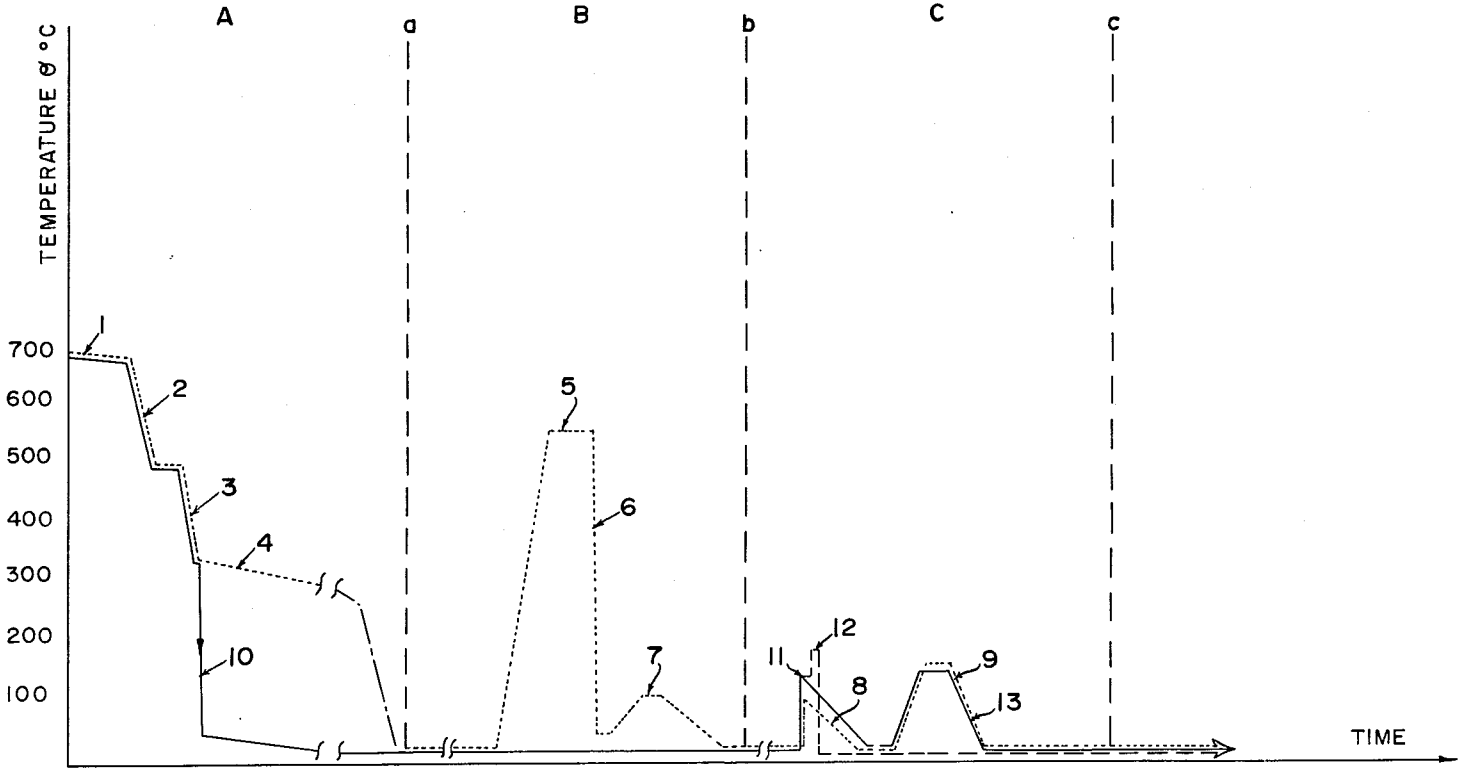

FIG. 3 also diagrammatically illustrates the various processing stages in the form of a graph in which time is recorded on the abscissa on an arbitrary scale while temperature is recorded on the ordinate. The axis of the ordinates and the three vertical parallel axes *a, b, c* determine three zones A, B, C which correspond respectively to the stages: production of the wire rod, treatment of the wire rod and final drawing/artificial aging.

The cycles illustrated in broken lines and in solid lines correspond to the application of the invention, while the cycle illustrated in dotted lines represents the conventional process.

For the conventional process, the successive curve sections correspond to the following phases:

1. liquid metal entering the casting wheel (Properzi for example)
2. solidification and cooling of the metal in the casting wheel
3. rolling in the rolling section (Properzi or Secim for example)
4. cooling of the wire rod in spool form
5. solution heat treatment
6. quenching with cold water
7. stoving
8. drawing
9. artificial aging in a static furnace followed by cable formation.

In the case of the process according to the invention, the successive curve sections correspond to the following phases 1, 2, and 3: identical with the conventional processes.

10. continuous cooling of the wire rod on leaving the rolling section
11. tepid drawing
12. continuous artificial aging
13. by way of modification: artificial aging in a static furnace where artificial aging has not been carried out continuously.

The curve sections interrupted by double lines correspond, on the time scale, to non-determined time intervals such as spontaneous cooling processes or periods of waiting between successive stages.

EXAMPLE 1

An A-GS/L alloy of the following composition:
Fe : 0.24%
Si : 0.55%
Mg : 0.59%
aluminum base, with the usual impurities in Al for electrical applications, was prepared cast in a Properzi mill provided at its output end with a continuous cooler of the type described in French Patent No. 2,261,816 and corresponding U.S. Pat. No. 3,945,623 under the various conditions shown in the following Table together with the corresponding mechanical characteristics of the wire rod (measured after aging for more than 15 days)

| Reference | Initial Rolling Temperature °C | Emulsion Rolling Temperature °C | Exit Temperature of Machine Wire °C | Characteristics of the Wire Rod (9.5) R kg/mm² | $A_{200}$ % |
|---|---|---|---|---|---|
| 1 | 425 | 70 | 60 | 18.7 | 10 |
| 2 | 450 | 70 | 60 | 19.2 | 11 |
| 3 | 475 | 70 | 60 | 19.1 | 13 |
| 4 | 500 | 70 | 60 | 20.3 | 14 |

First of all, part of the wire rod was drawn to 3 mm and 2 mm, respectively, under the usual conditions of the prior art with a final heat treatment lasting three hours at 165° C. The results obtained were as follows:

| Reference (and initial rolling temperature) | Characteristics ϕ 3.0 mm R kg/mm² | $A_{200}$ % | ρ μ Ω . cm | ϕ 2.0 mm R kg/mm² | $A_{200}$ % | ρ μ Ω . cm |
|---|---|---|---|---|---|---|
| 1 (425° C) | 30.5 | 6.2 | 3.125 | | | |
| 2 (450° C) | 31.5 | 6.5 | 3.177 | | | |
| 3 (475° C) | 32.2 | 7.5 | 3.184 | | | |
| 4 (500° C) | 34.6 | 4.2 | 3.247 | 34.0 | 5.0 | 3.125 |

Another part of the wire rod (references 3 and 4 above which gave the best results) was then subjected to so-called tepid drawing at 140° C with the following results (shown on page 12).

The improvement in characteristics is very significant (increase of 2 kg/mm² in R, drop in resistivity).

EXAMPLE 2

An A-GS/L alloy of the following composition:
Fe : 0.23%
Si : 0.49%
Mg : 0.56%
aluminum base with the usual impurities for electrical applications, was prepared, cast in a Properzi wheel, rolled at a temperature of 515° C on entering the mill and cooled to 60° C at the output end of the mill.

Two lengths of the wire rod were then subjected by way of comparison to conventional drawing and to tepid drawing in accordance with the invention to diameters of 3.0 mm and 2.0 mm. The results are shown below.

| Reference | Characteristics ϕ 3.0 mm R kg/mm² | $A_{200}$ % | ρ μ Ω . cm | Final Artificial Aging | ϕ 2.0 mm R kg/mm² | $A_{200}$ % | ρ μ Ω . cm | Final Artificial Aging |
|---|---|---|---|---|---|---|---|---|
| 3 (475° C) | 34.3 | 5.5 | 3.175 | (5h/140° C) | | | | |
| 4 (500° C) | 37.0 | 5.0 | 3.227 | (1h/140° C) | 36.8 | 5 | 3.174 | (1h/140° C) |
| | 36.8 | 5.5 | 3.166 | (7h/140° C) | | | | |

| Drawing | Final Heat Treatment | ϕ 3.0 mm R kg/mm² | $A_{200}$ % | ρ μΩ . cm | bending (r=10) | ϕ 2.0 mm R kg/mm² | $A_{200}$ % | ρ μΩ . cm | bending (r=5) |
|---|---|---|---|---|---|---|---|---|---|
| normal | 3h at 165° C | 35 | 7.7 | 3.263 | 7 | 36.4 | 6.7 | 3.263 | 5 |
| | 5h at 165° C | | | | | 34.6 | 4.2 | 3.177 | 6 |

-continued

| Drawing | Final Heat Treatment | φ 3.0 mm R kg/mm² | $A_{200}$ % | ρ μΩ . cm | bending (r=10) | φ 2.0 mm R kg/mm² | $A_{200}$ % | ρ μΩ . cm | bending (r=5) |
|---|---|---|---|---|---|---|---|---|---|
| tepid (140° C) | 5h at 140° C | 40.7 | 5.2 | 3.263 | 7 | | | | |
| | 1h at 140° C | | | | | 39.4 | 5.0 | 3.263 | 6 |

The increase in ultimate tensile strength is particularly significant, the other characteristics remaining unchanged.

EXAMPLE 3

An A-GS/L alloy of the following composition:

Fe : 0.25%

Si : 0.45%

Mg : 0.49% aluminum base with the usual impurities for electrical applications, was prepared, rolled under the same conditions as in Example 2 and then drawn partly in accordance with the prior art and partly in accordance with the invention (tepid drawing) to diameters of 3.0 mm and 2.0 mm with the following results which also show a very significant increase in R for otherwise the same characteristics.

| Drawing | Final Heat Treatment | φ 3.0 mm R kg/mm² | $A_{200}$ % | ρ μΩ. cm | bending around r=10mm | φ 2.0 mm R kg/mm² | $A_{200}$ % | ρ μΩ . cm | bending around r=10mm |
|---|---|---|---|---|---|---|---|---|---|
| normal | 3h at 165° C | 33.4 | 6.8 | 3.241 | 7 | 33.5 | 8 | 3.237 | 6 |
| tepid (140°C) | 3h at 140° C | 36.9 | 6 | 3.256 | 7 | 36.2 | 5 | 3.210 | 6 |

EXAMPLE 4

Tepid (140° C) drawn wire of Example 2, with a diameter of 2.0 mm, was subjected to thermal artificial aging for fifteen seconds at 220° C by passage through an oil bath.

The mechanical and electrical characteristics of the wire before and after this artificial aging treatment carried out continuously were as follows:

| | R kg/mm² | $A_{200}$ % | ρ μ Ω . cm |
|---|---|---|---|
| Immediately after tepid drawing (140° C) | 39.6 | 2 | 3.340 |
| After artificial aging for 15 seconds at 220° C | 38.7 | 5.5 | 3.270 |

The values obtained after tepid drawing and continuous artificial aging are comparable with those of the prior art which are given in Example 2.

These wires and cables obtained from them, which have remarkable characteristics and which, in addition, benefit by the high resistance to corrosion of aluminum alloys in general and AGS in particular, may of course be used for any applications where these qualities are required, for example for wire fencing, braces for vines and fruit trees, and guys for masts or aerials.

EXAMPLE 5

Two A-GS/L alloys of the following composition were prepared:

| | Fe % | Si % | Cu % | Mg % | Ti % |
|---|---|---|---|---|---|
| Alloy A | 0.20 | 0.47 | 0.018 | 0.50 | 0.01 |
| Alloy B | 0.20 | 0.47 | 0.10 | 0.50 | 0.01 |

(the other impurities being those normally encountered in aluminum for electrical applications).

These alloys were cast in a Properzi wheel, rolled at a temperature of 515° C on entry into the mill and then cooled to 60° C at the output end of the mill. The wire rod thus obtained was subjected to wire of alloy A, normal drawing to 3.45 mm; wire of alloy B, normal drawing to 3.45 mm and tepid drawing at 160° C to 3.45 mm.

Tepid drawing at 160° C was carried out in a four-pass drawing machine, the output rate amounting to 100 m/minute. The wire enters the machine cold and is brought to the tepid drawing temperature by immersion in the bath of lubricant thermostatically controlled to that temperature, the dies and the heads of the drawing machine being themselves immersed in the lubricant.

The tepid drawn 3.45 mm diameter wire is obtained in two drawing operations under the following conditions.

The three 3.45 mm diameter wires obtained were then subjected to different artificial aging treatments in a static furnace.

The mechanical traction characteristics and electrical resistivity values obtained immediately after drawing and after artificial aging are for example as follows:

| Alloy | Drawing | State of 3.45 diameter wire | R kg/mm² | $A_{200}$ % | ρ μ Ω . cm |
|---|---|---|---|---|---|
| A | normal | immediately after drawing | 31.4 | 4.0 | 3.390 |
| | | after artificial aging (7 h at 155° C) | 34.0 | 7.4 | 3.220 |
| B | normal | immediately after drawing | 31.3 | 5.2 | 3.410 |
| | | after artificial aging (7h at 155° C) | 35.3 | 8.1 | 3.232 |
| | tepid (160° C) | immediately after drawing | 30.6 | 4.0 | 3.375 |
| | | after artificial aging (12h at 145° C) | 37.5 | 7.9 | 3.240 |

I claim:

1. In a process for the production of a wire by the sequential steps of continuously casting and rolling of a bar of an aluminum-silicon alloy consisting of by weight from 0.30 to 0.80% of Mg, from 0.30 to 0.70% of Si, from 0.15 to 0.35% of Fe, less than 0.20% of Cu, and the remainder of aluminum and the usual impurities, said rolling being carried out at a temperature of between 400° and 500° C and drawing the rolled bar into wire, the improvement comprising immediately after drawing rapidly cooling said rolled bar to a temperature below 150° C, tepid drawing at a temperature of from about 110° C to about 180° C with an elongation of at least 350%, followed by artifically aging at a temperature between about 130° C and about 240° C wherein the ultimate tensile strength of the wire is about 37 $kg/mm^2$ to about 41 $kg/mm^2$.

2. A process for the production of wires of aluminum-magnesium-silicon alloy as defined in claim 1 wherein tepid drawing is carried out at a temperature of from 130° to 160° C.

3. A process for the production of wires of aluminum-magnesium-silicon alloy as set forth in claim 1 wherein the artificial aging is carried out in a bath-type static furnace over periods ranging from thirty minutes to twelve hours at nominal temperatures in the range from 130° to 170° C.

4. A process for the production of wires of aluminum-magnesium-silicon alloy as defined in claim 1 wherein the artificial aging at the output end of the drawing machine is carried out continuously at a temperature of from 180° C to 240° C for a residence time of from 1 to 30 seconds.

* * * * *